US011203873B2

(12) United States Patent
Hughes

(10) Patent No.: US 11,203,873 B2
(45) Date of Patent: Dec. 21, 2021

(54) BALUSTER SHOE AND METHOD FOR INSTALLATION

(71) Applicant: Daniel Hughes, Union, KY (US)

(72) Inventor: Daniel Hughes, Union, KY (US)

( * ) Notice: Subject to any disclaimer, the term of this patent is extended or adjusted under 35 U.S.C. 154(b) by 169 days.

(21) Appl. No.: 16/806,068

(22) Filed: Mar. 2, 2020

(65) Prior Publication Data

US 2021/0270042 A1 Sep. 2, 2021

(51) Int. Cl.
*E04F 11/18* (2006.01)

(52) U.S. Cl.
CPC ..... *E04F 11/1814* (2013.01); *E04F 11/1817* (2013.01)

(58) Field of Classification Search
CPC ..... E04F 11/18; E04F 11/181; E04F 11/1812; E04F 11/1814; E04F 11/1817; E04F 2011/1819; E04F 2011/1821; E04H 17/006; E04H 17/009
See application file for complete search history.

(56) References Cited

U.S. PATENT DOCUMENTS 225,683 A 3/1880 Brady
3,822,053 A * 7/1974 Daily ..... E04H 17/1439 256/22
3,915,434 A 10/1975 Lister
4,805,879 A * 2/1989 Spera ..... E04F 11/1844 256/65.12
5,382,001 A * 1/1995 Lichti ..... E04F 11/181 256/22
5,832,675 A 11/1998 Zuares
7,219,873 B2 * 5/2007 Harwood ..... E04H 12/2261 181/171
D544,107 S 6/2007 Timothy
7,470,091 B2 * 12/2008 Scholl ..... E02D 27/42 405/229
7,475,870 B2 1/2009 Platt
8,936,233 B1 * 1/2015 Sneith ..... E04F 11/1812 256/67
2003/0121539 A1 * 7/2003 Gu ..... E04B 1/34357 135/97

(Continued)

FOREIGN PATENT DOCUMENTS

EP 0641891 A1 3/1995
GB 2523343 A * 8/2015 ..... E04H 17/1417

(Continued)

*Primary Examiner* — Jonathan P Masinick
(74) *Attorney, Agent, or Firm* — Wood Herron & Evans LLP

(57) ABSTRACT

A two-piece baluster shoe and method for installation thereof on a baluster are provided. The baluster shoe is configured to engage with a baluster adjacent the connection of a baluster to a rail without the use of a discrete mechanical fastener, such as a set screw. The baluster shoe features an integrated resilient spring tongue that engages with the baluster, thereby securing the baluster shoe in place relative to the baluster and forcing the baluster shoe against the adjacent rail. The baluster shoe is formed in two shoe portions that snap together or otherwise are engaged with connector elements when positioned at the desired location adjacent a joint of the baluster with the rail, which can occur after the baluster is engaged with the rail.

20 Claims, 5 Drawing Sheets

(56) References Cited

U.S. PATENT DOCUMENTS

| | | | | |
|---|---|---|---|---|
| 2004/0026679 | A1* | 2/2004 | Terrels | E04H 17/1447 256/65.03 |
| 2014/0008597 | A1* | 1/2014 | Herman | E04F 11/1804 256/64 |
| 2018/0266119 | A1 | 9/2018 | Schneider et al. | |

FOREIGN PATENT DOCUMENTS

| | | | | |
|---|---|---|---|---|
| KR | 100915799 | B1 * | 9/2009 | |
| KR | 101051152 | B1 * | 7/2011 | |
| KR | 20160109033 | A * | 9/2016 | |
| WO | WO-2016127201 | A1 * | 8/2016 | E04F 11/1817 |

* cited by examiner

BALUSTER SHOE AND METHOD FOR INSTALLATION

TECHNICAL FIELD

The present invention relates generally to a railing assembly and, in particular, to a baluster shoe.

BACKGROUND

Baluster shoes are used to obscure from view the area on a railing where a baluster meets the rail, which may define an unattractive transition in the eyes of some. A standard baluster shoe consists of a single piece of cast metal through which a set screw is threaded in order to secure the baluster shoe in place on the baluster, abutting the rail.

In order to install a standard baluster shoe, the baluster shoe must be slid onto a baluster before the baluster is installed. Generally, after installation of the baluster abutting a rail, the baluster shoe cannot be removed from the baluster or reoriented on the baluster without first uninstalling the baluster from the rail. For example, if two baluster shoes to be positioned on opposite ends of the baluster are slid onto the baluster in the same orientation, e.g., with one upside down from the desired orientation, the baluster would need to be disconnected from the rail in order to correct the orientation of one of the baluster shoes. Necessarily having to the remove the baluster from the rail in order to remove or reorient the baluster shoe can result in inefficient installation of the baluster shoe and frustration on the part of the installer.

After the baluster shoe is slid onto the baluster and the baluster is installed onto the rail, the baluster shoe can be slid into position at the location where the baluster meets the rail. In order to secure a standard baluster shoe into place, a set screw is installed. The set screw is threaded through the exterior of the baluster shoe, often requiring an unsightly hole in the baluster shoe. The set screw then penetrates the baluster, which can permanently disfigure the surface of the baluster. The installation process requires an installer to hold the baluster shoe in place on the baluster with one hand while, at the same time, using the other hand to both hold and insert the set screw through a hole in the baluster shoe. Disadvantageously, this process requires coordination on the part of the installer and may be difficult to accomplish in the tight spaces between balusters.

The standard baluster shoe and the installation process associated therewith exhibit various shortcomings. Accordingly, there is a need for improvements to the baluster shoe, itself, and method for installing the baluster shoe onto a baluster.

SUMMARY

In accordance with an exemplary embodiment of the invention, a two-piece baluster shoe with an integrated resilient spring tongue is described. The two-piece construction of the recited baluster shoe avoids the problems associated with having to install a baluster shoe on the baluster prior to fixing the baluster to a rail. Additionally, the integrated resilient spring tongue provides for the baluster shoe to be secured in place on the baluster without the complications of using a set screw.

In an embodiment, the baluster shoe engages with a baluster near where the baluster is fastened to a rail in order to shroud the interface between the baluster and the rail. The two-piece baluster shoe includes a first shoe portion and a second shoe portion. The first shoe portion includes a wall member, which extends between a first end and a second end, and at least one connector element. Between the first end and the second end of the first shoe portion, there is defined an outer periphery and an inner periphery. The outer periphery is configured to face away from the baluster, while the inner periphery is configured to face towards the baluster. The second shoe portion includes an end wall and two side walls. The two side walls connect to and extend outwardly from the end wall. Further, the two side walls include at least one connector element. Like the wall member of the first shoe portion, the end wall and the two side walls of the second shoe portion extend between a first end and a second end. Between the first end and the second end of the second shoe portion there is defined an outer periphery and an inner periphery. The outer periphery is configured to face away from the baluster, while the inner periphery is configured to face towards the baluster. The second shoe portion further includes a resilient spring tongue that extends from the inner periphery. When the first and second shoe portions are removably attached together using corresponding connector elements, the inner periphery of the first shoe portion and the inner periphery of the second shoe portion combine to surround the baluster. With the first shoe portion and the second shoe portion surrounding the baluster, the resilient spring tongue of the second shoe portion engages with the baluster. Through engaging with the baluster, the baluster shoe is forced against the rail at the first end of the first shoe portion and the first end of the second shoe portion.

In another embodiment, the outer periphery of the first and second shoe portions of the baluster shoe tapers in size between the first and second ends to provide a transition between the baluster and the rail.

In another embodiment, the end wall and two side walls of the second shoe portion of the baluster shoe are arranged in a U-shape configuration.

In another embodiment, the connector elements of the first and second shoe portions of the baluster shoe include a pivot arm member and a pivot arm receptacle. Attaching the first and second shoe portions together includes inserting a pivot arm member into a pivot arm receptacle to bring together at least part of the first and second shoe portions. The pivot arm receptacle is configured to enable pivotable movement of the pivot arm member in the pivot arm receptacle. Pivotal movement of the pivot arm in the pivot arm receptacle causes a remainder of the first and second shoe portions to be brought together. In a different embodiment, the pivot arm member of the baluster shoe is located on the first shoe portion and the pivot arm receptacle is located on the second shoe portion. In yet another embodiment, the pivot arm member and the pivot arm receptacle of the baluster shoe are located proximate to the second ends of the first and second shoe portions.

In another embodiment, the connector elements of the first and second shoe portions of the baluster shoe of include a resilient tab member and a resilient tab receptacle slot. The resilient tab receptacle slot is configured to receive the corresponding resilient tab member in a snap engagement, thereby removably attaching the first and second shoe portions to each other. In a different embodiment, the resilient tab member is located on the first shoe portion and the resilient tab receptacle slot is located on the second shoe portion. In yet another embodiment, the resilient tab member and the resilient tab receptacle slot are located proximate to the first ends of the first and second shoe portions.

In another embodiment, the resilient spring tongue of the baluster shoe is fixedly coupled to the end wall of the second shoe portion. In a different embodiment, the resilient spring tongue extends from the fixed coupling on the end wall so as to project outwardly away from the end wall and in a direction of the first end of the second shoe portion, the resilient spring tongue remaining spaced apart from each of the two side walls.

Another embodiment of the invention is directed to a rail assembly featuring the above described baluster shoe. The rail assembly first includes an upper rail and a lower rail. The lower rail is spaced some distance below the upper rail. Further, the rail assembly includes at least one baluster. The baluster is positioned between and attached to both the upper rail and the lower rail. The baluster also includes a mating groove near an end of the baluster. Additionally, the rail assembly includes at least one baluster shoe, as described above. The baluster shoe engages with the baluster adjacent to the location where the baluster is connected to either the upper rail or the lower rail.

In another embodiment, the connector elements of the first and second shoe portions of the baluster shoe include a pivot arm member and a pivot arm receptacle. Removably attaching the first and second shoe portions includes inserting the pivot arm member into the pivot arm receptacle to bring together the first and second shoe portions. The pivot arm receptacle is configured to enable pivotable movement of the pivot arm member in the pivot arm receptacle. Pivotal movement of the pivot arm in the pivot arm receptacle causes a remainder of the first and second shoe portions to be brought together.

In another embodiment, the connector elements of the first and second shoe portions of the baluster shoe of include a resilient tab member and a resilient tab receptacle slot. The resilient tab receptacle slot is configured to receive the corresponding resilient tab member in a snap engagement, thereby removably attaching the first and second shoe portions to each other.

In another embodiment, the resilient spring tongue of the baluster shoe is fixedly coupled to the end wall of the second shoe portion. In a different embodiment, the resilient spring tongue extends from the fixed coupling on the end wall so as to project outwardly away from the end wall and in a direction of the first end of the second shoe portion, the resilient spring tongue remaining spaced apart from each of the two side walls.

Yet another embodiment is directed to a method for assembling a rail assembly featuring the above described baluster shoe. The method includes attaching a baluster to an upper rail and to a lower rail. The lower rail is spaced some distance below the upper rail. The baluster includes a mating groove near an end of the baluster. The method further includes fastening a baluster shoe to the baluster. The resilient spring tongue of the baluster shoe engages with the mating groove of the baluster and forces the baluster shoe against either the upper rail or the lower rail, adjacent to the location where the baluster connects to the rail.

In another embodiment, the step of fastening a baluster shoe to the baluster further includes aligning a first shoe portion of the baluster shoe on a side of the baluster with a second shoe portion on an opposing side of the baluster and engaging a connector element of the first shoe portion with the corresponding connector element of the second shoe portion such that when the first and second shoe portions are removably attached together using the corresponding connector elements, an inner periphery of the first shoe portion and an inner periphery of the second shoe portion combine to surround the baluster.

In another embodiment, the step of engaging a connector element of the first shoe portion with the corresponding connector element of the second shoe portion further includes inserting a pivot arm member of the first shoe portion into a corresponding pivot arm receptacle of the second shoe member such that the pivot arm receptacle is configured to enable pivotable movement of the corresponding pivot arm member therein and pivotally moving the first shoe portion about a contact between the pivot arm member of the first shoe portion and the corresponding pivot arm receptacle of the second shoe portion so that two side walls of the second shoe portion are guided into contact with a wall member of the first shoe portion.

In another embodiment, the step of engaging a connector element of the first shoe portion with the corresponding connector element of the second shoe portion further includes inserting a resilient tab member of the first shoe portion into a corresponding resilient tab receptacle slot of the second shoe portion such that the first shoe portion and second shoe portion snap into engagement with each other, removably securing the first and second shoe portions of the baluster shoe together, when the resilient tab member is fully inserted into the corresponding resilient tab receptacle slot.

The steps and elements described herein can be reconfigured and combined in different combinations to achieve the desired technical effects in different styles of baluster shoes, as may be needed in the art.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
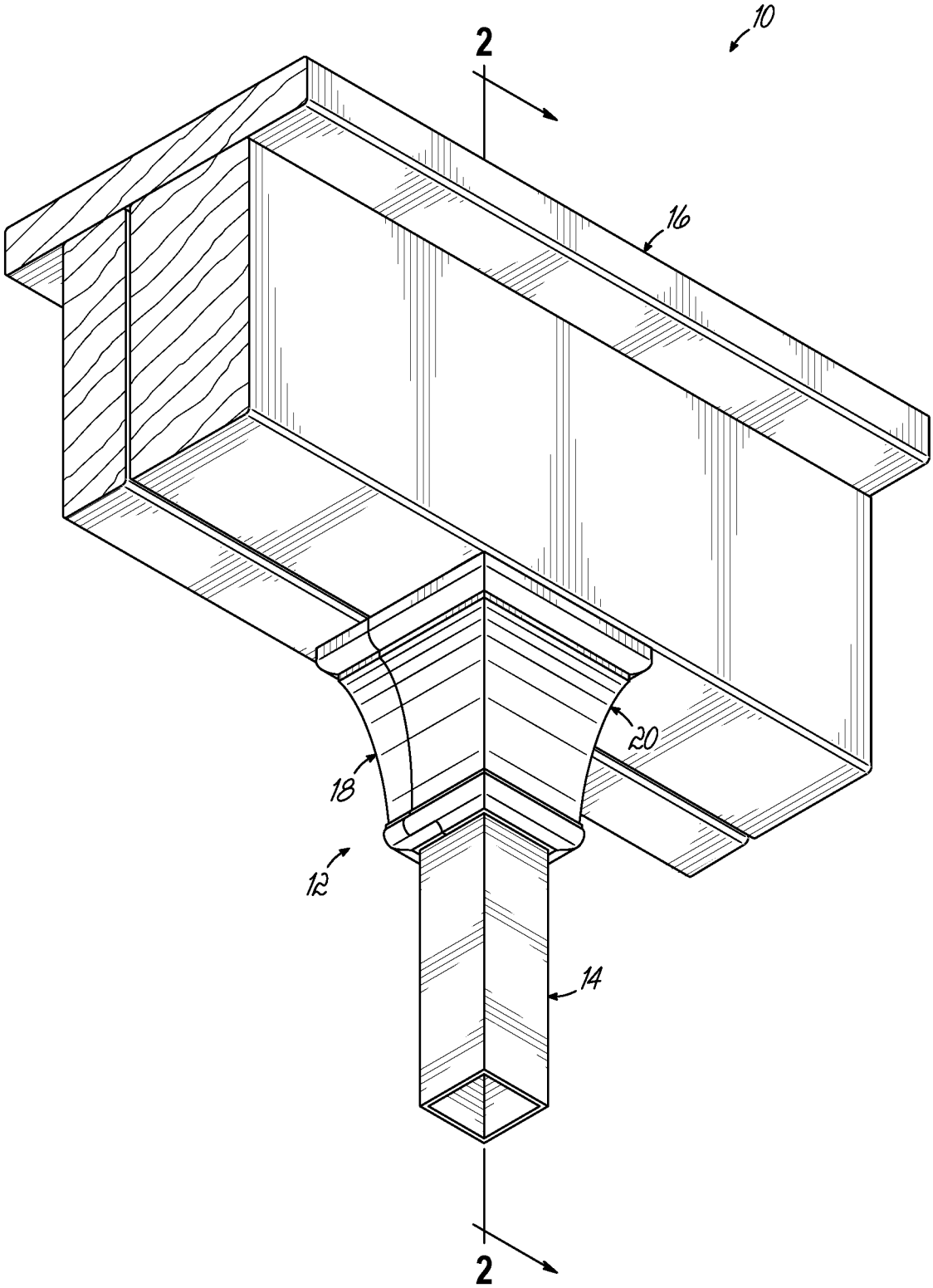
FIG. 1 is a bottom perspective view of a rail assembly featuring a rail, a baluster, and a baluster shoe according to an exemplary embodiment of the invention.

With reference to FIGS. 1 through 7, embodiments of a two-piece baluster shoe 12 with a resilient spring tongue 22 are shown in detail. The two-piece baluster shoe 12 is used during an associated method for installing said baluster shoe 12 on a baluster 14 in accordance with additional embodiments of the invention. Advantageously, the two-piece construction of the recited baluster shoe 12 avoids the problems of a traditional, one-piece baluster shoe. Whereas a one-piece baluster shoe must be installed on a baluster 14 prior to the baluster 14 being installed to a rail 16, the recited two-piece baluster shoe 12 can be fitted on a baluster 14 after the baluster 14 has been installed. A further advantage of the two-piece construction of the baluster shoe 12 is the ability to easily move or re-orient the baluster shoe 12 after installation. In contrast to a one-piece baluster shoe, which requires the removal of the baluster 14 in order to remove or re-orient the baluster shoe, the two-piece baluster shoe 12 can simply be separated into its two parts and removed or re-oriented as desired. Additionally, the resilient spring tongue 22 integrated into the body of the baluster shoe 12 provides for the baluster shoe 12 to be secured in place on a baluster 14 without the complications of using a set screw. The resilient spring tongue 22 engages with a mating groove 24 on the baluster 14 which forces the baluster shoe 12 against the adjacent rail 16 and holds the baluster shoe 12 in place on the baluster 14. This allows for the baluster shoe 12 to be quickly and easily installed without the need for additional tools and/or fasteners. Other advantages and technical effects of the embodiments of this invention will become evident to one skilled in the art from the following description.

Beginning with reference to FIG. 1, an exemplary rail assembly 10 is shown. The rail assembly 10 generally includes a baluster shoe 12 engaged with a baluster 14 adjacent a connection of the baluster 14 to the rail 16 and abutting the rail 16. The baluster 14 is attached to the rail 16. The baluster shoe 12 functions to cover the interface between the baluster 14 and the rail 16. The baluster shoe 12 of this embodiment is composed of two primary parts—the first shoe portion 18 and the second shoe portion 20. The first shoe portion 18 and the second shoe portion 20 combine to form the baluster shoe 12, which surrounds the baluster 14. It will be appreciated that the two-piece baluster shoe 12 construction permits the baluster shoe 12 to be installed after the baluster 14 is installed, in contrast to a traditional one-piece baluster shoe. Further, the two-piece baluster shoe 12 construction lends itself to quick and easy removal or re-orientation. When the baluster shoe 12 is installed on the baluster 14 as shown in FIG. 1, the connection between the rail 16 and the baluster 14 is obscured from view and the baluster shoe 12 provides an aesthetically pleasing visual transition between these elements. It will be appreciated that in this fully assembled and installed state, the baluster shoe 12 of this invention provides a desirable aesthetic appearance that is similar, if not identical, to the appearance provided by conventional one-piece baluster shoe designs.

Figure 2:
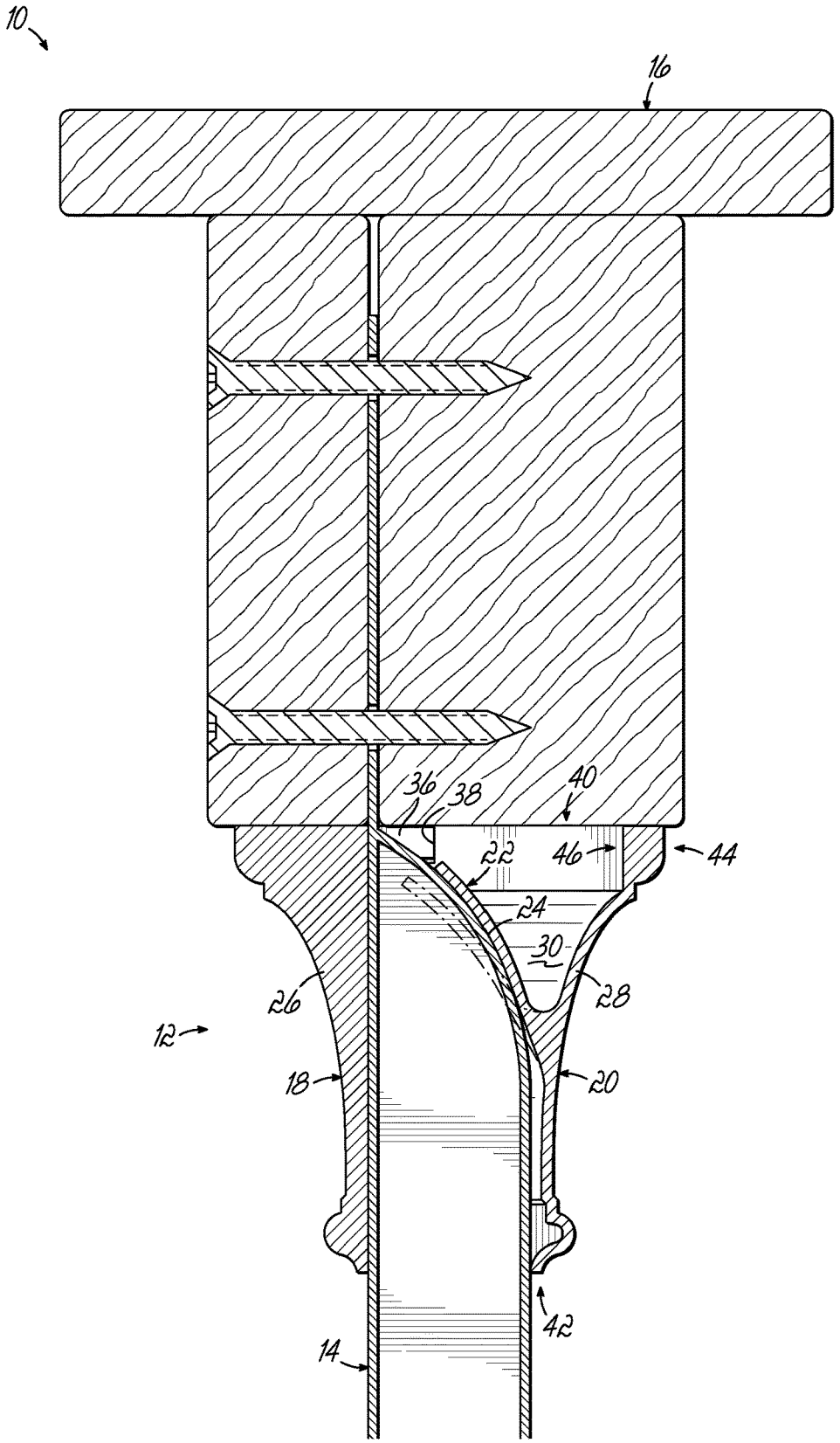
FIG. 2 is a side cross-sectional view of the rail assembly of FIG. 1.

Referring to FIG. 2, a side cross-sectional view of an exemplary rail assembly 10 is shown. In this embodiment, the rail 16 is composed of three subparts—a top handrail part and two lower rail parts that combine to support the top handrail piece and engage with the uppermost portion of a baluster 14. While the rail 16 of this embodiment features three parts, alternative rail constructions will be readily discernable by one of ordinary skill in the art. Only one rail of the upper and lower rails is shown in FIGS. 1 and 2 because it will be understood that the opposite rail on the other end of the baluster is configured in a similar or identical fashion. The flat, uppermost portion of the baluster 14 is sandwiched between the two lower rail parts and fastened to the two lower rail parts by means of screws. Other mechanical fasteners or techniques, known by those skilled in the art, can be used to secure the baluster 14 to the rail 16. The baluster 14 features a mating groove 24 at the top and bottom of the baluster 14, near the interface between the baluster 14 and the rail 16. Alternatively, the baluster 14 could feature a mating groove 24 at one end of the baluster 14 (either the top or bottom) or in the middle of the baluster 14, in the case of a baluster knuckle. In this embodiment, the mating groove 24 is a curved portion of the baluster 14 that provides a surface for the baluster shoe 12 to engage with. It is understood that the mating groove 24 could take on any number of forms and provide a surface for a baluster shoe 12 to engage with. For example, the mating groove 24 could be an aperture or slit in the baluster 14. Alternatively, the mating groove 24 could be a protrusion extending from the baluster 14 and configured to engage with the baluster shoe 12.

The baluster shoe 12 engages with the mating groove 24 of the baluster 14 by a resilient spring tongue 22 integrated into the second shoe portion 20 of the baluster shoe 12. When the baluster shoe 12 is placed on the baluster 14, the baluster 14 presses against the resilient spring tongue 22 and may slightly displace the resilient spring tongue 22 from its normal (unflexed) position within the baluster shoe 12, this normal position being shown in phantom in FIG. 2 for reference. The displacement of the resilient spring tongue 22 serves the purpose of forcing the baluster shoe 12 into engagement with the rail 16, which thereby secures the baluster shoe 12 in position adjacent the rail 16. The resilient spring tongue 22 serves the same purpose as a set screw in a traditional baluster shoe. However, the resilient spring tongue 22 provides the benefit of being integrated with the construction of the baluster shoe 12 as well as not requiring additional tools to fasten the baluster shoe 12 to the baluster 14.

Figure 3:
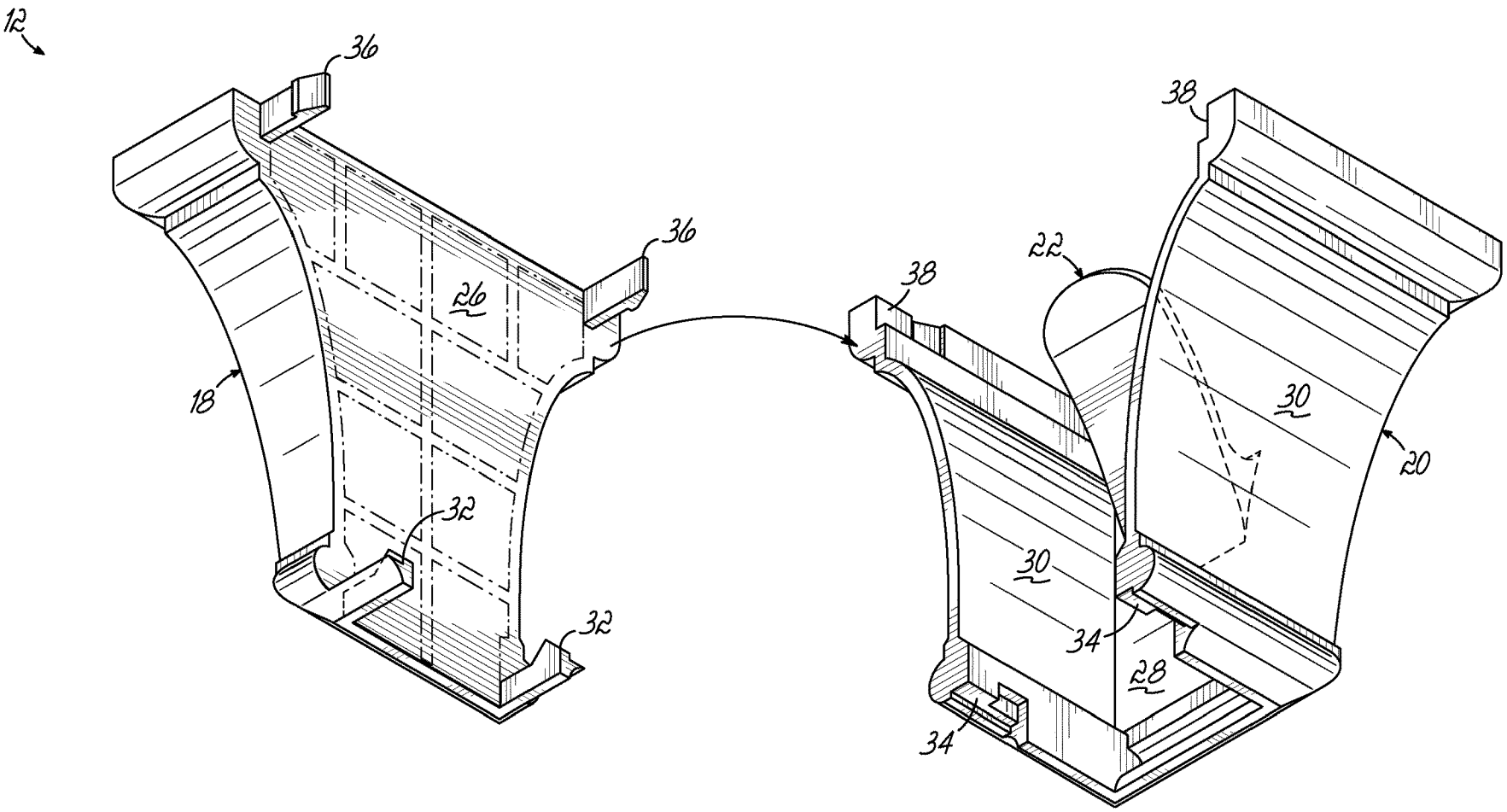
FIG. 3 is a perspective view of the first and second shoe portions of the baluster shoe of FIG. 1, separated from each other.

Referring to FIG. 3, a baluster shoe 12 is shown separated into its two parts—the first shoe portion 18 and the second shoe portion 20. The first shoe portion 18 features a wall member 26 and a plurality of connector elements. In this embodiment, the interior of the wall member 26 of the first shoe portion 18 facing the second shoe portion 20 is typically molded to include a "waffle iron" gridwork-like support structure depicted in phantom. It will be appreciated by one skilled in the art that the support structure of the wall member 26 of the first shoe portion 18 may take on any number of forms such as fully hollow interior or solid body, not illustrated in this embodiment, without departing from the overall inventive concept of the present invention. Further, a variety of configurations of the connector elements are shown in this embodiment (e.g., pivot arm member 32, pivot arm receptacle 34, resilient tab member 36, and resilient tab receptacle slot 38). It should be appreciated that there are additional types of connector elements, not illustrated in this embodiment, that could work to connect the first shoe portion 18 to the second shoe portion 20. The second shoe portion 20 features an end wall 28 and two side walls 30 that are connected to and extend outwardly from the end wall 28. As previously described, the second shoe portion 20 further features a resilient spring tongue 22. The resilient spring tongue 22 is attached to the end wall 28 of the second shoe portion 20. The resilient spring tongue 22 extends from the end wall 28 outwardly without touching either of the two side walls 30 of the second shoe portion 20. When the first shoe portion 18 and the second shoe portion 20 are joined, connector elements (e.g., pivot arm member 32 and resilient tab member 36) on the first shoe portion 18 combine with connector elements (e.g., pivot arm receptacle 34 and resilient tab receptacle slot 38) on the second shoe portion 20 and secure the two portions of the baluster shoe 12 together.

Figure 4:
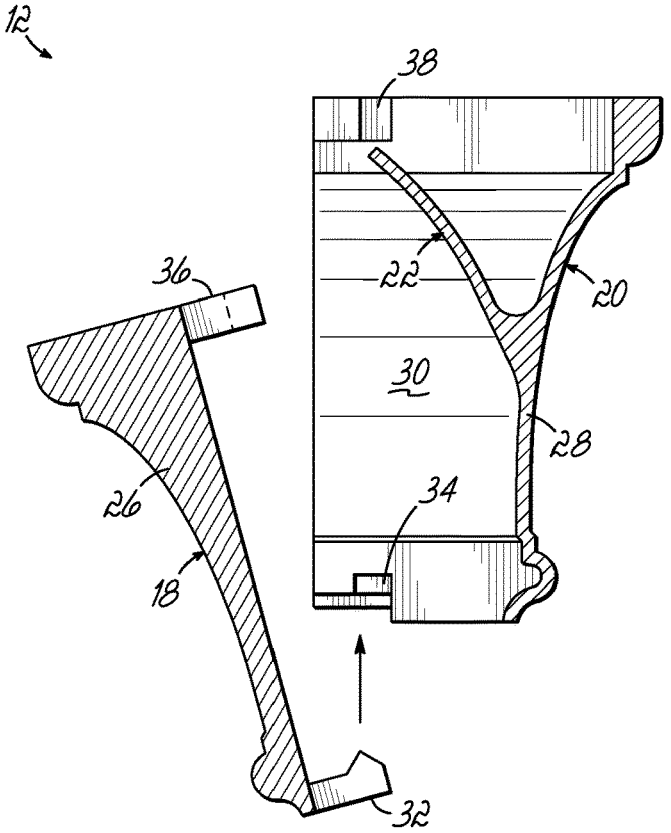
FIG. 4 is a side cross-sectional view of the first and second shoe portions of FIG. 3, showing a pivot arm member of the first shoe portion being inserted into a pivot arm receptacle of the second shoe portion.

Referring to FIG. 4, a first step of securing the first shoe portion 18 to the second shoe portion 20 to form the baluster shoe 12 is shown. A pivot arm member 32, which is one type of connector element, attached to the first shoe portion 18 is received by a pivot arm receptacle 34, which is another type of connector element, of the second shoe portion 20. After the pivot arm member 32 is received by the pivot arm receptacle 34, the tip of the pivot arm member 32 can pivotally move within the confines of the pivot arm receptacle 34. This allows the first shoe portion 18 to pivot into a preparatory position to be secured to the second shoe portion 20. The pivot arm member 32 and pivot arm receptacle 34 serve the important purpose of allowing a user to line up the first shoe portion 18 and second shoe portion 20 to be connected with limited visibility of the baluster shoe 12. By feel, a user can tell when the first shoe portion 18 and the second shoe portion 20 of the baluster shoe 12 are lined up because of the tactile feedback offered by the pivot arm member 32 being received by the pivot arm receptacle 34. Although this figure shows the pivot arm member 32 on the first shoe portion 18 and the pivot arm receptacle 34 on the second shoe portion 20, in an alternative embodiment the pivot arm member 32 may be on the second shoe portion 20 and the pivot arm receptacle 34 may be on the first shoe portion 18. Further, in an alternative embodiment, the connector elements of the first shoe portion 18 and the second shoe portion 20 need not specifically be a pivot arm member 32 and a pivot arm receptacle 34, but may be defined by other types of connector elements including the other examples described herein.

Figure 5:
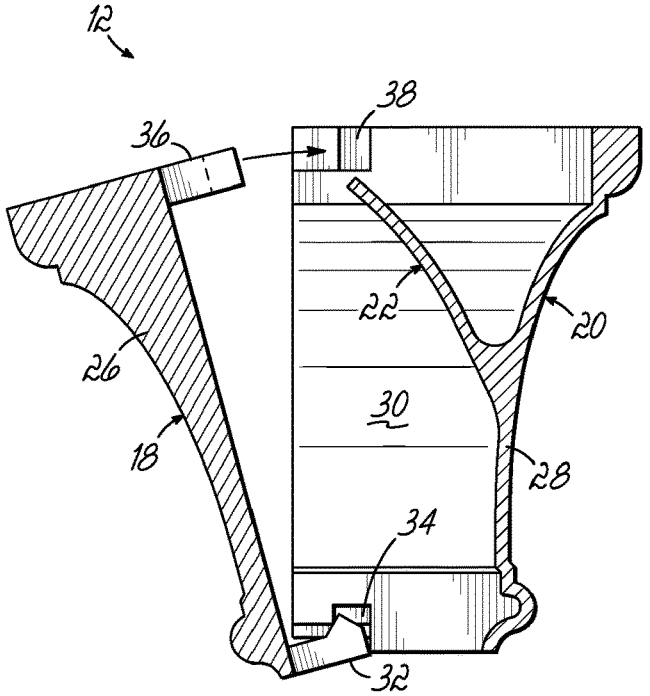
FIG. 5 is a side cross-sectional view similar to FIG. 4, showing pivotal movement of the first shoe portion about the pivot arm member in the pivot arm receptacle, thereby guiding a resilient tab member of the first shoe portion into a resilient tab receptacle slot of the second shoe portion.

Referring to FIG. 5, a second step of securing the first shoe portion 18 to the second shoe portion 20 to form the baluster shoe 12 is shown. A resilient tab member 36, one type of connector element, attached to the first shoe portion 18 is received by a resilient tab receptacle slot 38, another type of connector element, of the second shoe portion 20. The resilient tab member 36 is received by the resilient tab receptacle slot 38 which secures the first shoe portion 18 into contact with the second shoe portion 20. Fully inserting the resilient tab member 36 into the resilient tab receptacle slot 38 causes a snap engagement that can audibly or physically (by tactile feedback) notify a user that the first shoe portion 18 and the second shoe portion 20 are secured together. Although this figure shows the resilient tab member 36 on the first shoe portion 18 and the resilient tab receptacle slot 38 on the second shoe portion 20, in an alternative embodiment the resilient tab member 36 may be on the second shoe portion 20 and the resilient tab receptacle slot 38 may be on the first shoe portion 18. Further, in an alternative embodiment, the connector elements of the first shoe portion 18 and the second shoe portion 20 need not specifically be a resilient tab member 36 and resilient tab receptacle slot 38, but may be defined by other types of connector elements including the other examples described herein.

Figure 6:
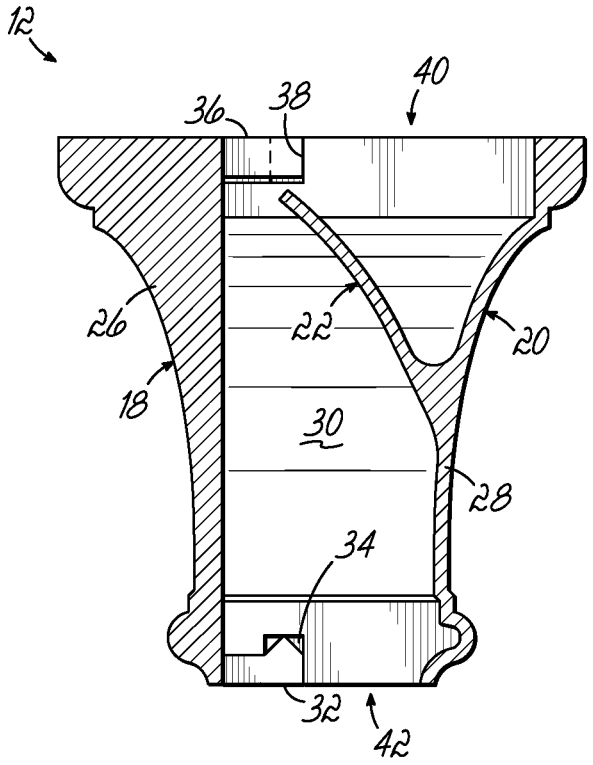
FIG. 6 is a side cross-sectional view similar to FIG. 5, showing the resilient tab member fully inserted into the resilient tab receptacle slot joining together the first shoe portion and the second shoe portion into full engagement.

Referring to FIG. 6, the baluster shoe 12 is shown in a fully assembled state, where a pivot arm member 32, one type of connector element, attached to the first shoe portion 18 is shown fully inserted in a pivot arm receptacle 34, another type of connector element, of the second shoe portion 20. Further, a resilient tab member 36, yet another type of connector element, attached to the first shoe portion 18 is shown fully inserted into a resilient tab receptacle slot 38, a further type of connector element, of the second shoe portion 20. Further, the fully formed baluster shoe 12 defines a first end 40 at one end of the baluster shoe 12 and a second end 42 of the baluster shoe 12 at the opposite end of the baluster shoe 12. Although this figure shows the pivot arm member 32 on the first shoe portion 18 and the pivot arm receptacle 34 on the second shoe portion 20, in an alternative embodiment the pivot arm member 32 may be on the second shoe portion 20 and the pivot arm receptacle 34 may be on the first shoe portion 18. Further, in an alternative embodiment, the connector elements of the first shoe portion 18 and the second shoe portion 20 need not specifically be a pivot arm member 32 and a pivot arm receptacle 34.

Figure 7:
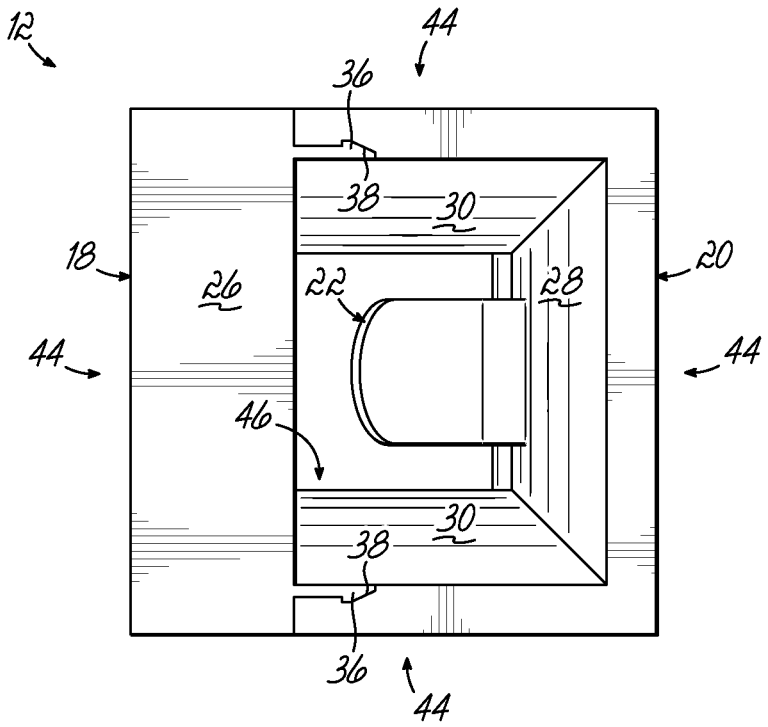
FIG. 7 is a top elevational view of the fully-engaged first shoe portion and second shoe portion of FIG. 6.

Referring to FIG. 7, a top view of the fully assembled baluster shoe 12 is shown. The interior of the baluster shoe 12 defines an inner periphery 46 around the inside of the baluster shoe 12. Further, the exterior of the baluster shoe 12 defines an outer periphery 44 around the exterior of the baluster shoe 12. Additionally, from the top view of the baluster shoe 12, a resilient tab member 36, a type of connector element, attached to the first shoe portion 18 is shown fully inserted into a resilient tab receptacle slot 38, a further type of connector element, of the second shoe portion 20. Further, the underside of the resilient spring tongue 22 is shown. Although this figure shows the pivot arm member 32 on the first shoe portion 18 and the pivot arm receptacle 34 on the second shoe portion 20, in an alternative embodiment the pivot arm member 32 may be on the second shoe portion 20 and the pivot arm receptacle 34 may be on the first shoe portion 18. Further, in an alternative embodiment, the connector elements of the first shoe portion 18 and the second shoe portion 20 need not specifically be a pivot arm member 32 and a pivot arm receptacle 34.

Advantageously, the two-piece construction of the recited baluster shoe 12 avoids the problems of a traditional, one-piece baluster shoe. Whereas a one-piece baluster shoe must be installed on a baluster 14 prior to the baluster 14 being installed to a rail 16, the recited two-piece baluster shoe 12 can be fitted on a baluster 14 after the baluster 14 has been installed. Further, because of the two-piece construction of the baluster shoe 12, the baluster shoe 12 can be easily moved or re-oriented after installation. In contrast to a one-piece baluster shoe, which requires the removal of the baluster 14 in order to remove or re-orient the baluster shoe, the two-piece baluster shoe 12 can simply be separated into its two parts and removed or re-oriented as desired. Additionally, the resilient spring tongue 22 integrated into the body of the baluster shoe 12 provides for the baluster shoe 12 to be secured in place on a baluster 14 without the complications of using a set screw. This allows for the baluster shoe 12 to be quickly and easily installed without the need for additional tools and/or fasteners. Other advantages and technical effects of the embodiments of this invention will become evident to one skilled in the art from the preceding description.

While the present invention has been illustrated by the description of various preferred embodiments and while these embodiments have been described in some detail, it is not the intention of the Applicant to restrict or in any way limit the scope of the appended claims to such detail. For example, while the outer periphery 44 of the baluster shoe 12 is shown with a rectangular shape in the illustrated embodiment, it will be understood that other outer profiles may be defined by the baluster shoe 12 depending on the aesthetic preferences of the end user or installer. The various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A baluster shoe configured to engage with a baluster adjacent a connection of the baluster to a rail, the baluster shoe comprising:

a first shoe portion including a wall member extending between a first end and a second end, and at least one connector element extending from the wall member, the first shoe portion between the first and second ends defining an outer periphery configured to face away from the baluster and an inner periphery configured to face towards the baluster; and a second shoe portion including an end wall and two side walls connected to and extending from the end wall, with the two side walls including at least one connector element, each of the end wall and the two side walls extending between a first end and a second end, the second shoe portion between the first and second ends defining an outer periphery configured to face away from the baluster and an inner periphery configured to face towards the baluster, and the second shoe portion further includes a resilient spring tongue extending from the inner periphery, wherein when the first and second shoe portions are removably attached together using the at least one connector element on each of the first and second shoe portions, the inner periphery of the first and second shoe portions surrounds the baluster with the resilient spring tongue engaging the baluster to force the baluster shoe against the rail at the first ends of the first and second shoe portions.

2. The baluster shoe of claim 1, wherein the outer periphery of the first and second shoe portions tapers in size between the first and second ends to provide a transition between the baluster and the rail.

3. The baluster shoe of claim 1, wherein the end wall and two side walls of the second shoe portion are arranged in a U-shape configuration.

4. The baluster shoe of claim 1, wherein the at least one connector element of the first and second shoe portions collectively comprise:

at least one pivot arm member; and at least one pivot arm receptacle, wherein removably attaching the first and second shoe portions further includes inserting the at least one pivot arm member into the at least one pivot arm receptacle to bring together at least part of the first and second shoe portions, the at least one pivot arm receptacle being configured to enable pivotable movement of the at least one pivot arm member therein, such pivotal movement causing a remainder of the first and second shoe portions to be brought together.

5. The baluster shoe of claim 4, wherein the at least one pivot arm member is located on the first shoe portion and the at least one pivot arm receptacle is located on the second shoe portion.

6. The baluster shoe of claim 4, wherein the at least one pivot arm member and the at least one pivot arm receptacle are located proximate to the second ends of the first and second shoe portions.

7. The baluster shoe of claim 1, wherein the at least one connector element of the first and second shoe portions collectively comprise:

at least one resilient tab member; and at least one resilient tab receptacle slot, wherein the at least one resilient tab receptacle slot is configured to receive the corresponding at least one resilient tab member in a snap engagement, thereby removably attaching the first and second shoe portions to each other.

8. The baluster shoe of claim 7, wherein the at least one resilient tab member is located on the first shoe portion and the at least one resilient tab receptacle slot is located on the second shoe portion.

9. The baluster shoe of claim 7, wherein the at least one resilient tab member and the at least one resilient tab receptacle slot are located proximate to the first ends of the first and second shoe portions.

10. The baluster shoe of claim 1, wherein the resilient spring tongue is fixedly coupled to the end wall of the second shoe portion.

11. The baluster shoe of claim 10, wherein the resilient spring tongue extends from the fixed coupling on the end wall so as to project outwardly away from the end wall and in a direction of the first end of the second shoe portion, the resilient spring tongue remaining spaced apart from each of the two side walls.

12. A rail assembly, comprising:

an upper rail;

a lower rail, wherein the lower rail is spaced below the upper rail;

at least one baluster positioned between and attached to the upper rail and the lower rail, wherein the baluster comprises a mating groove near an end of the baluster; and at least one baluster shoe configured to engage with a baluster adjacent a connection of the baluster to one of the upper rail and the lower rail, the baluster shoe comprising:

a first shoe portion including a wall member extending between a first end and a second end, and at least one connector element extending from the wall member, the first shoe portion between the first and second ends defining an outer periphery configured to face away from the baluster and an inner periphery configured to face towards the baluster; and a second shoe portion including an end wall and two side walls connected to and extending from the end wall, with the two side walls including at least one connector element, each of the end wall and the two side walls extending between a first end and a second end, the second shoe portion between the first and second ends defining an outer periphery configured to face away from the baluster and an inner periphery configured to face towards the baluster, and the second shoe portion further includes a resilient spring tongue extending from the inner periphery, wherein when the first and second shoe portions are removably attached together using the at least one connector element of each of the first and second shoe portions, the inner periphery of the first and second shoe portions surrounds the baluster with the resilient spring tongue engaging the baluster to force the baluster shoe against the one of the upper rail and the lower rail at the first ends of the first and second shoe portions.

13. The baluster shoe of claim 12, wherein the at least one connector element of the first and second shoe portions collectively comprise:

at least one pivot arm member; and at least one pivot arm receptacle, wherein removably attaching the first and second shoe portions further includes inserting the at least one pivot arm member into the at least one pivot arm receptacle to bring together the first and second shoe portions, the at least one pivot arm receptacle configured to enable pivotable movement of the at least one pivot arm member therein, such pivotal movement causing the first and second shoe portions to be brought together.

14. The baluster shoe of claim 12, wherein the at least one connector element of the first and second shoe portions collectively comprise:

at least one resilient tab member; and at least one resilient tab receptacle slot, wherein the at least one resilient tab receptacle slot is configured to receive the corresponding at least one resilient tab member in a snap engagement, thereby removably attaching the first and second shoe portions to each other.

15. The baluster shoe of claim 12, wherein the resilient spring tongue is fixedly coupled to the end wall of the second shoe portion.

16. The baluster shoe of claim 15, wherein the resilient spring tongue extends from the fixed coupling on the end wall so as to project outwardly away from the end wall and in a direction of the first end of the second shoe portion, the resilient spring tongue remaining spaced apart from each of the two side walls.

17. A method for assembling a rail assembly, the method comprising:

attaching a baluster, which includes a mating groove near an end of the baluster, to an upper rail and to a lower rail, the lower rail spaced below the upper rail; and fastening a baluster shoe to the baluster, wherein a resilient spring tongue of the baluster shoe is configured to engage with the mating groove of the baluster and force the baluster shoe against one of the upper rail and the lower rail adjacent a connection of the baluster to that one of the upper rail and the lower rail.

18. The method of claim 17, wherein the step of fastening a baluster shoe to the baluster further comprises:

aligning a first shoe portion of the baluster shoe on a side of the baluster with a second shoe portion on an opposing side of the baluster; and engaging a connector element of the first shoe portion with a connector element of the second shoe portion such that when the first and second shoe portions are removably attached together using the connector elements, an inner periphery of the first shoe portion and an inner periphery of the second shoe portion combine to surround the baluster.

19. The method of claim 18, wherein the step of engaging the connector element of the first shoe portion with the connector element of the second shoe portion further comprises:

inserting a pivot arm member of the first shoe portion into a pivot arm receptacle of the second shoe portion such that the pivot arm receptacle is configured to enable pivotable movement of the pivot arm member therein; and pivotally moving the first shoe portion about a contact between the pivot arm member of the first shoe portion and the pivot arm receptacle of the second shoe portion so that two side walls of the second shoe portion are guided into contact with a wall member of the first shoe portion.

20. The method of claim 18, wherein the step of engaging the connector element of the first shoe portion with the connector element of the second shoe portion further comprises:

inserting a resilient tab member of the first shoe portion into a resilient tab receptacle slot of the second shoe portion such that the first shoe portion and second shoe portion snap into engagement with each other, removably securing the first and second shoe portions of the baluster shoe together, when the resilient tab member is fully inserted into the corresponding resilient tab receptacle slot.

* * * * *